United States Patent [19]

Rudszinat

[11] 4,306,573

[45] Dec. 22, 1981

[54] METHOD AND APPARATUS FOR PRODUCING ROD-LIKE TOBACCO FILLERS

[75] Inventor: Willy Rudszinat, Dassendorf, Fed. Rep. of Germany

[73] Assignee: Hauni-Werke KUM/o/ rber & Co. KG, Hanburg, Fed. Rep. of Germany

[21] Appl. No.: 971,433

[22] Filed: Dec. 20, 1978

[30] Foreign Application Priority Data

Jan. 9, 1978 [DE] Fed. Rep. of Germany ..... 2800748

[51] Int. Cl.[3] ..... A24B 7/14

[52] U.S. Cl. ..... 131/84 C; 131/904

[58] Field of Search ..... 131/21 B, 21 C, 21 D, 131/21 R, 67, 84 C, 36

[56] References Cited

U.S. PATENT DOCUMENTS

| | | | |
|---|---|---|---|
| 2,208,504 | 7/1940 | Arelt | 131/67 |
| 2,952,262 | 9/1960 | Pocock et al. | 131/904 |
| 3,608,562 | 9/1971 | Gormann | 131/84 C |
| 3,736,941 | 6/1973 | Molins et al. | 131/21 R |
| 3,841,337 | 10/1974 | Varner | 131/84 C |
| 4,069,829 | 1/1978 | Molins et al. | 131/84 C |
| 4,121,595 | 10/1978 | Heitmann et al. | 131/21 R |

FOREIGN PATENT DOCUMENTS

| | | | |
|---|---|---|---|
| 961731 | 6/1964 | United Kingdom | 131/21 D |
| 1239408 | 7/1971 | United Kingdom | 131/21 R |

*Primary Examiner*—Robert W. Michell
*Assistant Examiner*—Thomas Wallen
*Attorney, Agent, or Firm*—Peter K. Kontler

[57] ABSTRACT

A growing tobacco stream is formed at the underside of a foraminous belt conveyor and is transported past two trimming devices to be converted into a rod-like filler which is thereupon draped into cigarette paper and severed to yield discrete plain cigarettes which are united with filter plugs to form filter cigarettes of unit length or double unit length. The resistance of successive identical sections of the filler to axial and/or transverse flow of air therethrough is monitored, and the resulting signals are used to adjust the second trimming device when the monitored resistance deviates from a desired value. The envelopes of filter plugs on successive filter cigarettes are perforated by a laser which is adjustable by signals denoting deviations of the mass of tobacco per unit length of the filler from a preselected value, deviations of the resistance of filter plugs to axial flow of air therethrough from a preselected value and/or deviations of the permeability of cigarette paper from a preselected value. This insures that the column of gaseous fluid which enters the mouth of a smoker contains a mixture of tobacco smoke and of a predetermined quantity of cool atmospheric air.

22 Claims, 3 Drawing Figures

METHOD AND APPARATUS FOR PRODUCING ROD-LIKE TOBACCO FILLERS

BACKGROUND OF THE INVENTION

The present invention relates to a method and apparatus for making a rod-like filler which consists of tobacco or another smokable material. More particularly, the invention relates to improvements in a method and apparatus for making a rod-like filler from a stream which consists of shreds or otherwise configurated particles and is trimmed so as to remove the surplus whereby the remaining shreds constitute the filler. For the sake of simplicity, the invention will be described with reference to the making of rod-like fillers which consist of tobacco shreds and are intended for the mass-production of plain or filter tipped cigarettes. It is to be understood, however, that the method and apparatus can be used with equal advantage for the making of other types of rod-shaped smokers' products including cigarettes known as papyrossi as well as plain or filter tipped cigars, cigarillos and cheroots. The term "shreds" is intended to denote all types of particulate smokable material including those which are obtained by subjecting tobacco leaves, sheets of reconstituted tobacco and/or shreds of artificial tobacco to the comminuting action of orbiting knives in shredding machines, as well as constituents of smokable portions of plain or filter tipped cigars, cigarillos and cheroots.

Manufacturers of cigarettes strive to form a continuous rod-like tobacco filler which contains identical or practically identical quantities of shreds in each and every portion thereof, i.e., it is desirable to form a filler whose density is constant from increment to increment. This insures the making of cigarettes wherein the density of tobacco-containing portions matches or closely approximates a desired optimum value. As a rule, the filler is obtained by removing the surplus of tobacco from a continuous tobacco stream which contains shreds in quantities exceeding those required in the filler. The surplus is removed by a trimming or equalizing device which removes tobacco from one side of the continuously moving tobacco stream another side of which (namely, that side which is located opposite the one side) adheres to or is supported by an elongated conveyor. Adjustments in the rate of removal of tobacco from the stream are effected by moving the rotating knife or knives of the removing device toward or away from the conveyor, i.e., by varying the thickness or height of the remaining portion of the stream. The position of the knife or knives with respect to the conveyor (and more particularly the distance between the cutting plane or planes of the knife or knives and the conveyor) is regulated in response to signals which are generated by a density measuring device, for example, a beta ray detector having a source of corpuscular radiation at one side of the filler and an ionization chamber or another suitable signal generating element at the other side of the filler opposite the source. The intensity or another characteristic of signals which are transmitted by the ionization chamber is indicative of the degree of absorption of radiation by successive increments of the filler and hence of density of the corresponding portions of the filler. It is also known to resort to density measuring devices which employ means for conveying a stream of gaseous fluid transversely across the filler and an electropneumatic transducer which generates signals denoting one or more characteristics of the tobacco-modulated fluid stream, such characteristic or characteristics being indicative of the density of corresponding portions of the filler. An important advantage of fillers whose density is constant or nearly constant is that such fillers can be converted into cigarettes of predictable weight. The minimum acceptable weight of cigarettes is prescribed by authorities, and the manufacturers attempt to maintain the weight of cigarettes as close to the minimum acceptable level as possible in order to achieve savings in tobacco, i.e., in the most expensive constituent of cigarettes.

It is also known to provide the wrappers of cigarettes, especially so-called light filter cigarettes, with perforations in the form of holes which are machined into the wrappers or envelopes of filter plugs and serve to admit cool atmospheric air into the column of tobacco smoke. Thus, when the purchaser of a pack of filter cigarettes lights a cigarette, tobacco smoke is mixed with a certain amount of cool atmospheric air which enters the cigarette by way of the aforediscussed holes and influences the nicotine and condensate content of gaseous fluid which enters the smoker's mouth. It is desirable to admit a relatively high percentage of cool atmospheric air in such a way that the ratio of atmospheric air to tobacco smoke is constant from cigarette to cigarette. This ratio of cool atmospheric air to tobacco smoke in the column of gaseous fluid which issues from the free end of the filter plug is known as the degree of ventilation.

It has been found that mere regulation of density of the fillers of plain or filter tipped cigarettes cannot prevent pronounced fluctuations of the degree of ventilation, i.e, such degree is likely to vary within a wide range even if the density of each and every increment of the tobacco filler in each of a series of cigarettes equals or closely approximates a preselected optimum value. One reason for this is that the resistance which successive cigarettes of a series of such articles offer to the axial flow of a gaseous fluid (tobacco smoke or a mixture of tobacco smoke with atmospheric air) therethrough is not necessarily constant when the density of tobacco fillers in such articles is constant or identical. There are certain other factors which also influence the degree of ventilation, for example, permeability of the wrappers of plain cigarettes and/or uniting bands which connect plain cigarettes with filter plugs and the characteristics of filter plugs.

OBJECTS AND SUMMARY OF THE INVENTION

An object of the invention is to provide a novel and improved method of making plain or filter cigarettes in such a way that the degree of ventilation of each of a long series of cigarettes equals or closely approximates the optimum value.

Another object of the invention is to provide a novel and improved method of removing the excess from a stream of tobacco shreds which is to be converted into a rod-like tobacco filler in such a way that, upon draping into a web of cigarette paper or the like and subdivision into discrete sections of predetermined length, each and every section will exhibit a desired and acceptable degree of ventilation.

A further object of the invention is to provide a method which insures the achievement of a desired degree of ventilation even if the ventilation-influencing characteristics of one or more constituents of plain or filter cigarettes fluctuate within a wide range and at unpredictable intervals.

An additional object of the invention is to provide a method which can be practiced by resorting to relatively simple and compact apparatus and which enables the manufacturer to maintain the weight of cigarettes close to the minimum acceptable weight without adversely influencing the degree of ventilation of such smokers' products.

Another object of the invention is to provide an apparatus which can be incorporated into or combined with a maker (e.g., a cigarette making machine, a filter tipping machine or a combination of such machines) to insure that the maker turns out rod-shaped smokers' products having an optimum or nearly optimum degree of ventilation.

A further object of the invention is to provide the apparatus with novel and improved means for removing excess tobacco from a continuous tobacco stream in such a way that the remaining tobacco forms a filler whose degree of ventilation is more satisfactory than that of fillers which are produced in accordance with heretofore known techniques.

An ancillary object of the invention is to provide novel and improved means for adjusting one or more tobacco removing devices in an apparatus wherein a stream of tobacco shreds is converted into a continuous rod-like tobacco filler.

Another object of the invention is to provide an apparatus of the above outlined character which can be used to regulate the operation of one or more perforating units serving to make holes in the wrapping material of rod-shaped smokers' products for the purpose of admitting cool atmospheric air into the column of tobacco smoke.

A further object of the invention is to provide a perforating unit which can be adjusted in response to transmission of one, two or more signals each of which is indicative of a different characteristic of one or more constituents of plain or filter tipped cigarettes.

An additional object of the invention is to provide an apparatus which can change the degree of ventilation of smokers' products with a minimum of delay following detection of deviations of such degree from an optimum value and which does not contribute excessively to the initial and/or maintenance cost of makers of plain or filter tipped cigarettes.

One feature of the invention resides in the provision of a method of producing a rod-like filler from shreds or otherwise configurated particles which consist of tobacco or another smokable material (such as reconstituted tobacco, tobacco substitutes or a mixture of such substances). The method comprises the steps of building a continuous stream wherein each unit length contains a surplus of smokable material (i.e., a quantity of shreds in excess of that in a unit length of the filler), moving the stream lengthwise, removing the excess from successive increments of the moving stream to convert the moving stream into a moving filler, generating a signal which is a function of resistance of the filler to the axial flow of a gas therethrough, and utilizing the signal for adjustment of the removing step when the resistance of the filler deviates from a predetermined value.

The signal generating step may include ascertaining the resistance of successive increments of the moving filler (e.g., of successive equally long rod-like portions of the filler) to the flow of a gas therethrough, and the adjusting step may include respectively removing larger and smaller quantities of shreds when the resistance of such increments or portions respectively exceeds and is below the predetermined value.

The removing step may include removing the excess or surplus in several (preferably two) successive stages. This is advisable when the excess includes an inner or first layer of constant thickness adjacent to that portion of the stream which is to constitute the filler and an uneven outer or second layer whose unevenness is attributable to accidental fluctuations of the quantity of shreds in corresponding increments of the stream. The aforementioned stages then include a first stage of removing the outer layer and a second stage of removing the inner layer.

The signal generating step may comprise conveying a stream of a gaseous fluid (e.g., air) transversely across successive increments of the filler and ascertaining that pneumatic value (e.g., pressure) of the fluid stream which fluctuates as a function of deviations of resistance of successive increments of the filler to the flow of the fluid stream from a predetermined resistance.

Alternatively, the signal generating step can be carried out subsequent to draping of the filler into a web of cigarette paper or other suitable wrapping material and subdividing the draped filler into a succession of rod-like sections of predetermined length. The signal generating step then comprises conveying a stream of a gaseous fluid (e.g., air) axially through successive sections and ascertaining that pneumatic value (e.g., the pressure or the rate of flow) of the fluid stream which fluctuates as a function of deviations of resistance of successive sections to flow of the fluid stream from a predetermined resistance.

The method may further comprise the steps of draping the filler into a web of air-permeable wrapping material, generating a second signal which is a function of permeability of the wrapping material, and utilizing the second signal for adjustment of the removing step when the monitored permeability of the wrapping material deviates from a predetermined value. Such method may further comprise the steps of subdividing the draped filler into a succession of rod-like sections of predetermined length, perforating the wrapping material of successive sections including making at least one hole in the wrapping material of each section, and utilizing the second signal for adjustment of the perforating step (such perforating step may include puncturing the wrapping material by resorting to needles or the like or resort to a laser beam) so as to change the cross-sectional area of holes in the wrapping material of rod-like sections when the monitored permeability of wrapping material deviates from the respective predetermined value.

Alternatively, the method may further comprise the steps of generating an additional signal which is a function of the quantity of shreds in successive increments of the filler and utilizing the additional signal for adjustment of the removing step when the monitored quantity deviates from a predetermined value. It is further clear that the removing step can be adjusted by resorting to all three signals, i.e., to a signal which denotes the resistance of the filler to the flow of a gas axially or transversely therethrough, to a signal which denotes the permeability of wrapping material, and to a signal which denotes the quantity of shreds per unit length of the filler. Furthermore, the additional signal can be utilized, in the same way as the second signal, to adjust the perforating step whenever the monitored quantity of shreds deviates from the respective predetermined value when the method includes the perforating step.

The method may further include the steps of draping the filler into a web of wrapping material, subdividing the filler into a succession of rod-like sections (e.g., plain cigarettes) of predetermined length, connecting each section with a filter plug to form a succession of filter tipped rod-shaped smokers' products (e.g., filter cigarettes of unit length of multiple unit length), perforating the wrapping material of successive products including making at least one hole in the wrapping material of each product, generating further signals as a function of the resistance to the flow of a gaseous fluid axially through the filter plugs, and utilizing such further signals for adjustment of the perforating step so as to change the cross-sectional area of holes in the wrapping material of the products when the monitored resistance of filter plugs deviates from a predetermined value.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
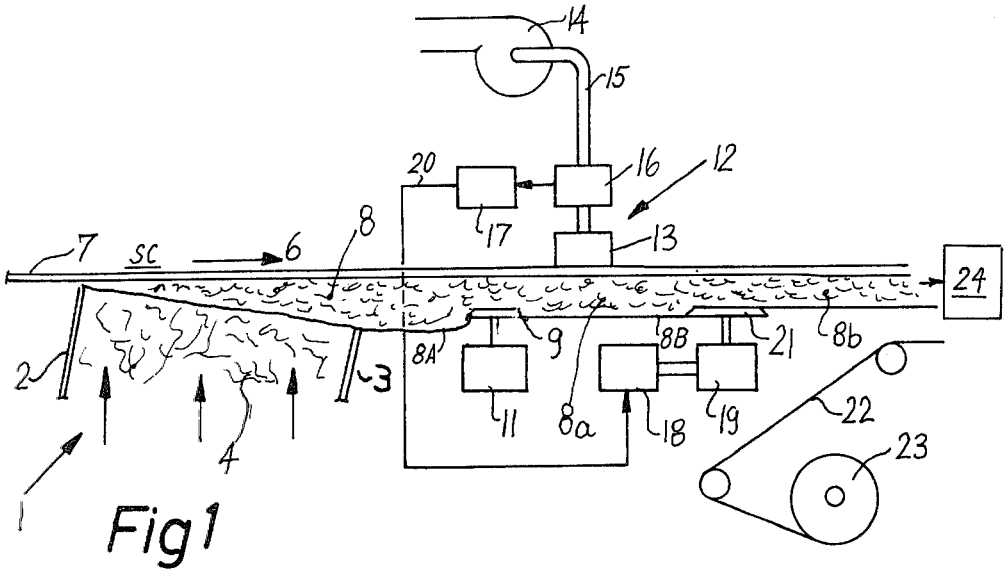
FIG. 1 is a schematic elevational view of a portion of a cigarette making machine wherein a continuous stream of tobacco shreds is converted into a rod-like tobacco filler in accordance with one embodiment of the invention.

FIG. 1 shows a portion of a cigarette making machine wherein a continuous stream 8 of tobacco shreds 4 is converted into a continuous rod-like tobacco filler **8*b*. The basic construction and mode of operation of this machine are similar to the construction and mode of operation of many conventional machines. Thus, the machine comprises an upright or nearly upright duct 1 which conveys a shower of tobacco shreds 4 to the underside of the elongated lower reach of an endless stream forming foraminous belt conveyor 7 so that the lower reach accumulates a wedge-like growing tobacco stream 8 whose maximum height (at the right-hand side of the discharge end of the duct 1) exceeds the height of the filler 8*b*. In other words, the fully grown stream 8 contains a quantity of tobacco shreds which is in excess of that required in the filler 8*b*. The duct 1 comprises two parallel or nearly parallel side walls 2, 3 and two additional walls (not specifically shown) which extend between the illustrated walls 2, 3 and define therewith a channel wherein the shower of tobacco shreds 4 advances upwardly toward the underside of the lower reach of the conveyor 7. The lower reach of this conveyor advances in the direction which is indicated by arrow 6. The means for causing the shower of tobacco shreds 4 to rise in the duct 1 may comprise a suction chamber SC at the upper side of the lower reach of the foraminous conveyor 7 and/or mechanical means for propelling the shreds upwardly. Such mechanical means may comprise one or more picker rollers or brushes which are installed at the lower end or inlet of the duct 1. Reference may be had to commonly owned U.S. Pat. No. Re 29,042 granted Nov. 23, 1976 to David which shows a distributor employing a rotary brush to propel tobacco shreds against one reach of a foraminous belt conveyor. The suction chamber SC insures that the ascending currents of air which penetrate through the lower reach of the foraminous conveyor 7 attract the shreds 4 of the growing stream to the underside of the lower reach, i.e., that the particles of the stream 8 share the movement of the lower reach of the conveyor 7 in the direction which is indicated by the arrow 6**.

As mentioned above, the quantity of shreds 4 in the fully grown tobacco stream 8 exceeds the required quantity of shreds in the filler **8*b*. Therefore, the apparatus of FIG. 1 comprises means for removing the excess or surplus so as to convert the stream 8 into the filler 8*b*. The illustrated removing means comprises devices which remove the excess in two steps. A first equalizing or trimming device of the removing means comprises at least one rotary disc-shaped knife 9 which is installed at a fixed distance from the underside of the lower reach of the conveyor 7 and removes the unequal lower or outer layer or stratum 8A of tobacco shreds 4 to thereby convert the stream 8 into a partly trimmed or smoothed stream 8*a*. The shreds 4 which form the outer layer 8A constitute undesirable accidental accumulations of tobacco particles at the underside of the stream 8, i.e., accumulations which are attributable in part or entirely to uneven distribution of shreds in the shower which is supplied by the duct 1. The knife 9 is driven by a suitable motor 11, and the removed shreds and their fragments are preferably returned into the magazine which supplies shreds to the lower or intake end of the duct 1**.

The second trimming or equalizing device of the removing means comprises one or more additional disc-shaped knives 21 which are caused to rotate in a plane other than the plane of the knife 9 and serve to remove from the smoothed or once trimmed stream **8*a* a second layer or stratum 8B of tobacco shreds 4 to thereby convert the stream 8*a* into the rod-like filler 8*b* which is ready for wrapping into a web 22 of cigarette paper or other suitable wrapping material. The knife 9 can be installed at a fixed distance from the underside of the lower reach of the conveyor 7. On the other hand, the plane of the knife 21 can be moved toward or away from the lower reach of the conveyor 7 so as to vary the thickness of the layer 8B whose material is also returned to the aforementioned magazine in a manner well known in the art and not forming part of the present invention. The knife 21 is driven by a motor 19 of the second trimming device and this motor, together with the knife 21 (or the knife 21 alone), can be moved toward or away from the lower reach of the conveyor 7 by a shifting unit 18 which is responsive to electric signals supplied by the transducer 16 of a signal generating device 12 serving to monitor a characteristic of the smoothed stream 8***a*. In the apparatus of FIG. 1, the device 12 monitors the resistance which successive increments of the smoothed stream 8*a* offer to the flow of a gaseous fluid (preferably air) transversely across the stream 8*a*. To this end, the device 12 further comprises a suction chamber 13 which draws a stream of air transverse across successive increments of the stream 8*a* between the knives 9 and 21. A pipe 15 connects the chamber 13 with the suction side or intake of a fan 14, and this pipe contains the aforementioned transducer 16 (e.g., a diaphragm transducer of the type disclosed in commonly owned U.S. Pat. No. 3,412,856 granted Nov. 26, 1968 to Esenwein) which transmits to the shifting device 18 electric signals via conductor means 20. The conductor means 20 contains a function generator 17. The characteristics of signals which are transmitted via conductor means 20 are indicative of a pneumatic value of the air stream which flows in the pipe 15, and such pneumatic value is indicative of or can be processed to denote the resistance which successive unit lengths of the stream 8*a* offer to axial flow of a gaseous fluid (e.g., a mixture of cool atmospheric air and tobacco smoke) through successive unit lengths of the filler 8*b*.

The function generator 17 is optional. Its purpose is to modify electric signals which are transmitted by the output of the transducer 16 in such a way that signals which are transmitted to the shifting device 18 are indicative of the resistance which successive unit lengths of the stream 8*a* offer to axial flow of a gas therethrough. It will be recalled that the suction chamber 13 of the signal generating device 12 draws air transversely across successive increments of the stream 8*a*, i.e., those signals which are generated by the transducer 16 are only indirectly indicative of the resistance which successive unit lengths of the stream 8*a* offer to axial flow of air therethrough. In other words, if the function generator 17 is omitted, the device 18 shifts the cutting plane of the knife 21 toward or away from the underside of the lower reach of the conveyor 7 in response to signals which are not directly indicative of the resistance of successive unit lengths of the stream 8*a* and filler 8*b* to axial flow of a gas therethrough (for the sake of simplicity, such resistance will be called drag resistance). On the other hand, the provision of function generator 17 insures that signals which are transmitted by the transducer 16 are modified so that each signal which the function generator 17 transmits to the input of the shifting device 18 is directly indicative of drag resistance of the corresponding unit length of the stream 8*a*. If the drag resistance deviates from a desired or optimum resistance, the shifting device 18 adjusts the plane of the knife 21 accordingly, i.e., the plane is moved nearer to the conveyor 7 if the drag resistance is higher than desired, and the knife 21 is moved away from the conveyor 7 if the drag resistance is too low. The device 18 may comprise a suitable signal comparing stage which compares incoming signals with a reference signal denoting the optimum drag resistance and transmits a signal for adjustment of the plane of the knife 21 when the intensity or another characteristic of the incoming signals (from 16 or 17) deviates from the same characteristic of the reference signal. Such signal comparing stages are well known in the art (see the stage 40 of FIG. 2) and are used in many types of control systems for cigarette making and like machines. For example, the shifting device 18 can be designed to adjust the plane of the knife 21 when a signal denoting the average value of drag resistance of a predetermined length of the stream 8*a* (such length can match the length of a plain cigarette of unit length) deviates from the drag resistance which is represented by a reference signal.

The means for moving the knife 21 or the parts 19, 21 toward and away from the lower reach of the conveyor 7 may comprise a reversible electric, pneumatic or other servomotor of any known design which is responsive to signals transmitted by the conductor means 20 or to signals which are transmitted by the aforementioned signal comparing stage of the shifting device 18 to move the part 19 and/or 21 upwardly or downwardly, as viewed in FIG. 1. The ultimate result is that each unit length of the filler 8*b* exhibits the same drag resistance.

The filler 8*b* is thereupon advanced into and through a wrapping mechanism which includes a source (e.g., a bobbin 23) of suitable wrapping material (the aforementioned cigarette paper web 22). The illustrated wrapping material 22 is a web of porous cigarette paper which is draped around the filler 8*b* so that the draped filler constitutes a continuous cigarette rod which is severed at regular intervals by a conventional cutoff 24 to yield a file of discrete plain cigarettes 33 (see FIG. 2) of unit length or multiple unit length. Such plain cigarettes can be transported to storage, directly to a packing machine, or to a filter tipping machine which connects each cigarette with a simple or composite filter plug by resorting to adhesive-coated uniting bands. A production line which includes a cigarette making machine and a filter tipping machine is shown in FIG. 3.

The main purpose of the first trimming device including the knife 9 is to insure that the position of the knife 21 is not changed in response to each accidental (short-lasting) fluctuation in the thickness of the stream 8 and hence in the resistance which successive increments of the stream offer to transverse flow of a gaseous fluid therethrough. Thus, the suction chamber 13 draws a stream of gaseous fluid across a smoothed tobacco stream or filler, and the changes in one or more characteristics of the signal which is transmitted by the transducer 16 are attributable only to parameters other than accidental fluctuations in thickness of the stream 8.

Figure 2:
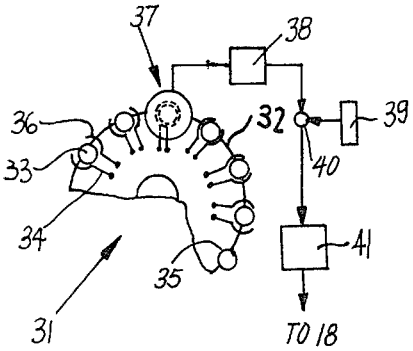
FIG. 2 is a fragmentary schematic end elevational view of a signal generating device which can be utilized to regulate the removal of excess tobacco from the tobacco stream in the apparatus of FIG. 1.
Figure 3:
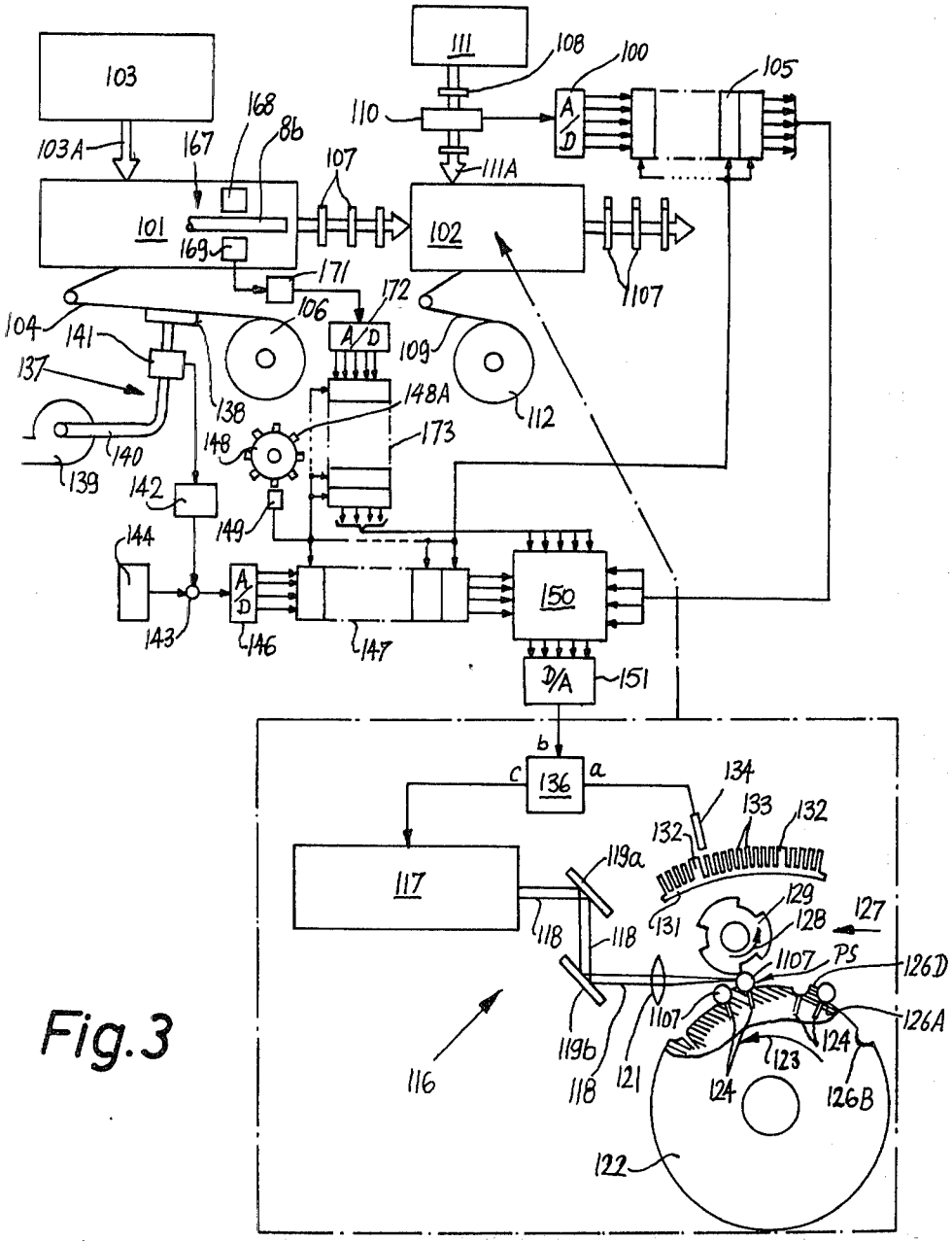
FIG. 3 is a schematic side elevational view of a production line including a machine of the type shown in FIG. 1 and a filter tipping machine, and further showing a perforating unit for the filter plugs of filter cigarettes as well as several signal generating devices which influence the operation of the perforating unit so as to insure that each of a series of successively produced filter cigarettes exhibits a desirable degree of ventilation.

FIG. 2 shows a different signal generating device 31 which can be used in addition to but preferably as a substitute for the signal generating device 12 of FIG. 1. The signal generating device 31 can directly ascertain the drag resistance of successive unit lengths or sections (plain cigarettes 33) of the filler 8*b* (subsequent to draping) and transmits appropriate signals to the shifting device 18 for adjustment of the plane of the knife 21 in the second trimming or equalizing device of the surplus removing means. In other words, the signal generating device 31 need not employ the function generator 17 of FIG. 1 because it tests finished rod-shaped smokers' products (cigarettes 33) by causing a stream of a gaseous testing fluid to flow axially through the products.

Referring more specifically to FIG. 2, the testing device 31 comprises a preferably drum-shaped testing conveyor 32 which is formed with axially parallel peripheral cigarette-receiving means in the form of flutes 35. The flutes 35 communicate with radially inwardly extending suction ports (not specifically shown in FIG. 2) which are connected with a suction generating device during certain stages of each revolution of the conveyor 32 so as to hold the cigarette 33 in the respective flutes. The conveyor 32 further carries a pair of pivotable or otherwise movable sealing flaps 34, 36 for each flute 35. The purpose of such flaps is to sealingly surround the wrappers of cigarettes 33 during travel past a testing station 37 where a stream of gaseous testing fluid (e.g., air) is caused to pass axially through the wrapper whereby a characteristic of the stream issues from or which is about to enter the cigarette is indicative of drag resistance of the respective section of the filler 8*b*. Flaps which can be used on or with the conveyor 32 of FIG. 2 are disclosed, for example, in commonly owned U.S. Pat. No. 3,339,402 granted Sept. 5, 1967 to Rudszinat. The fluid medium which flows through the filler of a cigarette 33 at the testing station 37 may be blown or sucked through the respective wrapper. In either event, a characteristic of the stream of testing fluid is monitored by an electropneumatic transducer 38 which transmits appropriate electric signals to one input of a signal comparing stage 40. The other input of the stage 40 receives a reference signal from a source 39 of reference signals. When the intensity or another characteristic of the signal which is transmitted by the transducer 38 deviates from the corresponding characteristic of the reference signal (such reference signal denotes the desired drag resistance of the filler 8*b*), the output of the signal comparing stage 40 transmits a signal to an integrating circuit 41 whose output is connected with the shifting device 18 of FIG. 1. The signal at the output of the integrating circuit 41 denotes the deviation of signals obtained on monitoring of a single cigarette 33 or of a predetermined number of successive cigarettes 33 from the reference signal which is supplied by the source 39.

The flaps 34 and 36 seal the wrapper of that cigarette 33 which is located at the testing station 37 so that the characteristics of the fluid stream which is monitored by the transducer 38 are not influenced by any parameters other than drag resistance of the filler of a cigarette at the station 37. Thus, the flaps 34, 36 prevent eventual holes, open seams or other defects from influencing the rate at which testing fluid flows axially through the filler of the cigarette 33 at the station 37.

An advantage of the signal generating device 31 is that it can directly ascertain the drag resistance of successive equally long sections of the filler 8*b*. On the other hand, the signal generating device 12 of FIG. 1 exhibits the advantage that the testing operation is carried out ahead of the second trimming or equalizing device. In other words, the device 31 can be used for a follow-up control of removal of the layer 8B, whereas the device 12 can insure that the plane of the knife 21 is adjusted (when necessary) before the corresponding unit length or section of the smoothed or partially equalized stream 8*a* undergoes the second stage of the surplus-removing operation.

FIG. 3 shows an apparatus which is installed in a production line including a cigarette making machine or maker 101 which is directly and rigidly coupled with a filter tipping machine 102. The production line further comprises a perforating unit 116 which provides the envelopes of filter plugs of filter cigarettes with holes or perforations for admission of cool atmospheric air into the column of tobacco smoke. The apparatus which is installed in the production line of FIG. 3 is designed to regulate the combined cross-sectional area of holes which are formed by the perforating unit 116 in such a way that the degree of ventilation of each filter cigarette matches a desired value in spite of the fact that such degree of ventilation can be influenced by parameters other than those discussed in connection with the description of FIGS. 1 and 2. Thus, the apparatus of FIG. 3 can take into consideration those parameters which influence the degree of ventilation of filter cigarettes, i.e., rod-shaped smokers' products which are not produced by the cigarette making machine 101 alone. Such additional parameters are monitored by further signal generating devices including a device 137 which monitors the permeability of the foraminous web 104 of cigarette paper or other wrapping material (this web corresponds to the web 22 of FIG. 1) and a device 110 which monitors the drag resistance of filter plugs prior to admission of such filter plugs into the filter tipping machine 102.

The exact design of the cigarette making machine 101 forms no part of the present invention. FIG. 3 merely shows a magazine 103 which constitutes a source of particles or shreds consisting of tobacco or another smokable material and supplies shreds in the direction indicated by the arrow 103A. The thus supplied shreds are converted into a filler 8*b* in a manner as described in connection with FIG. 1 (it should be noted, however, that the first trimming device including the knife 9 of FIG. 1 is optional) and the filler 8*b* is thereupon draped into the web 104 of wrapping material which is supplied by a bobbin 106 corresponding to the bobbin 23 of FIG. 1. The machine 101 discharges at least one row of plain cigarette 107 which are obtained by severing the wrapped filler 8*b* at regular intervals, e.g., by a cutoff corresponding to the device 24 of FIG. 1. Such row of cigarettes 107 is introduced into the filter tipping machine 102 wherein the cigarettes are connected with filter plugs 108 supplied by a magazine 111.

It is to be noted that the shreds which are supplied by the magazine 103 in the direction of arrow 103A need not be admitted directly into the duct 1 of FIG. 1. For example, the shreds can enter a suitable distributor (for example, a distributor disclosed in commonly owned U.S. Pat. No. 3,996,944 granted Dec. 14, 1976 to Hinzmann) wherein the shreds form a thin carpet or fleece which is thereupon showered into the duct 1 for introduction into the stream building zone of the machine 101.

The web 104 is caused to advance along a suitable paster which applies a film of adhesive to one of its marginal portions, and such marginal portion is caused to overlap the other marginal portion of the web 104 during draping around the filler 8*b*. The overlapping marginal portions form the customary seam which extends in parallelism with the axis of the continuous cigarette rod.

A filter tipping machine which can be used in the production line of FIG. 3 is known as MAX S (produced by the assignee of the present application). Reference may be had to commonly owned U.S. Pat. No. 4,037,608 granted July 26, 1977 to Wahle which describes the MAX S machine in considerable detail. The aforementioned signal generating device 110 is located adjacent to the path of movement of filter plugs 108 from the magazine or source 111 to the filter tipping machine 102. For example, the magazine 111 can be remote from the machine 102; the arrow 111A of FIG. 3 then denotes a pneumatic sender which shoots filter plugs 108 into the hopper of the machine 102 or a direct link-up system (such as manufactured and sold by the assignee of the present application under the name "Resy").

The signal generating device 110 may comprise a rotary drum-shaped conveyor which is analogous to the conveyor 32 of FIG. 2. During travel past the testing station, successive filter plugs 108 are monitored for drag resistance and the transducer or the integrating circuit of the device 110 transmits appropriate signals (denoting deviations of measured drag resistance from satisfactory drag resistance) to an analog-to-digital converter 100 forming part of means for transmitting signals to the control system 136 (e.g., a suitable circuit) of the perforating unit 116.

The filter tipping machine 102 further receives a continuous web 109 which is withdrawn from a bobbin 112 and is subdivided into discrete uniting bands which are used to connect filter plugs 108 with plain cigarettes 107. Reference may be had to the aforementioned U.S. Pat. No. 4,037,608 which describes the MAX S machine. The uniting bands may consist of cigarette paper, imitation cork or other suitable wrapping material. As a rule, one side of the web 109 is coated with adhesive prior to subdivision into discrete uniting bands, and such bands are thereupon rolled around the filter plugs 108 and adjacent plain cigarettes 107 to convert the filter plugs and the respective plain cigarettes into filter cigarettes 1107. In many filter tipping machines, two plain cigarettes 107 are connected with a filter plug of double unit length to form filter cigarettes of double unit length, and each such cigarette is thereupon severed midway across the filter plug to yield two filter cigarettes 1107. Prior to admission into storage or into a packing machine, one cigarette 1107 of each pair of coaxial cigarettes 1107 is inverted end-for-end so that all cigarettes 1107 form a single row wherein each filter plug of unit length faces in the same direction. The conversion of discrete adhesive-coated uniting bands into tubular envelopes which sealingly connect filter plugs 108 with plain cigarettes 107 preferably takes place while successive groups (each of which includes a filter plug and one or two plain cigarettes) are caused to roll between two surfaces at least one of which moves with respect to the other surface. The manner in which the uniting bands can be rolled around the just discussed groups of coaxial rod-shaped articles is disclosed, for example, in commonly owned U.S. Pat. No. 3,483,873 granted Dec. 16, 1969 to Hinzmann.

The perforating unit 116 serves to make holes in the envelopes of filter plugs 108, i.e., in the convoluted uniting bands which are obtained on severing of the web 109. If the outermost layers of filter plugs 108 are porous, and the porosity of such outer layers is sufficiently uniform, it suffices to make holes in the envelopes consisting of the wrapping material of the web 109. If the outermost layers of filter plugs 108 are not porous, the unit 116 makes holes in the aforementioned envelopes (convoluted portions of the web 109) as well as in the outermost layers of the filter plugs 108. Such outermost layers normally consist of paper or a similar material which can be readily perforated by mechanical means, by sparks or by one or more laser beams, depending on the design of the perforating unit which is installed in or combined with the filter tipping machine 102. The illustrated perforating unit 116 comprises an adjustable laser 117 which is energizable to emit a laser beam 118 serving to burn holes in the envelopes of filter cigarettes 1107, namely, in the envelopes of the filter plugs forming part of such cigarettes. If the machine 102 is designed to produce filter cigarettes of double unit length, the unit 116 preferably perforates the envelopes of filters prior to subdivision of filter cigarettes of double unit length into filter cigarettes 1107 of unit length. Reference may be had to the commonly owned copending application Ser. No. 963,087 filed Nov. 22, 1978 by Franz-Peter Koch et al. which discloses suitable perforating units for making holes in filter cigarettes of unit length or in filter cigarettes of double unit length.

The laser beam 118 which is emitted by the laser 117 is reflected by mirrors **119*a*, 119*b* and is focused by an optical system 121 so as to impinge upon the envelopes of successive filter plugs 108 at a perforating station PS shown in the lower right-hand portion of FIG. 3. As mentioned above, the beam 118 can burn holes in the envelopes (portions of the web 109) as well as in outer layers of the filter plugs 108 so as to insure that, when a filter cigarette 1107 is lighted, the column of tobacco smoke which flows into the smoker's mouth is mixed with a requisite quantity of cool atmospheric air which enters the filter plug via holes formed by the beam 118. The perforating station PS is defined by a drum-shaped conveyor 122 having alternating peripheral flutes 126A and 126B. Two neighboring flutes 126A, 126B are separated from each other by a rib 126D which extends in parallelism with the axis of the conveyor 122, and each of the flutes 126A, 126B communicates with one or more radially inwardly extending suction ports 124 which attract the cigarette 1107 during certain stages of each revolution of the conveyor 122. The latter is driven by the common prime mover (not shown) for the machines 101, 102 to rotate in the direction indicated by arrow 123**.

The perforating station PS is further defined by a rotary drum-shaped rolling device 127 which is driven to rotate in the direction indicated by arrow 128 and has three lobes or sets of lobes 129 cooperating with the conveyor 122 in a manner as disclosed in detail in the aforementioned copending application Ser. No. 963,087 of Franz-Peter Koch et al. to cause each cigarette 1107 which reaches the station PS to roll about its own axis in a clockwise direction, as viewed in FIG. 3, so as to interrupt its movement in the direction of arrow 123 while the outer envelope of its filter plug is perforated by the laser beam 118. During rolling about its own axis, a cigarette 1107 leaves its flute 126A and the rolling movement is terminated when the cigarette completes a full revolution about its axis and enters the oncoming flute 126B to thereupon again move in the direction which is indicated by the arrow 123.

While the cigarette 1107 at the station PS rolls about its own axis, the laser 117 is energized at least once but preferably more than once (refer to the aforementioned copending application Ser. No. 963,087 of Franz-Peter Koch et al.) so that it provides the outer envelope of the filter plug 108 with one or more annuli or other suitable arrays of relatively small holes or perforations. The means for transmitting impulses to the laser 117 comprises the aforementioned control circuit 136 whose input a receives signals denoting the arrival of a cigarette 1107 at the station PS and whose output c transmits such signals (or modified signals) to the laser 117. The means for transmitting signals to the input a of the control circuit 136 comprises a rotary member 131 which is driven by the aforementioned prime mover of the machines 101, 102 in synchronism with rotation of the conveyor 122 and rolling device 127 and has groups or sets of first projections 133 alternating with discrete second projections 132. The projections 132, 133 travel past a proximity detector 134 whose output transmits signals to the input a of the control circuit 136. When a projection 132 moves past the detector 134, the latter transmits a signal denoting that a cigarette 1107 is located at the perforating station PS (i.e., that the perforating operation can begin). The projections 133 of the group immediately following such projection 132 thereupon cause the detector 134 to transmit a series of signals at regular or other intervals while the cigarette 1107 at the station PS rotates about its own axis. Each such signal initiates the firing of the laser 117 so that the laser emits a series of beams 118 at short intervals while a cigarette 1107 is located at the station PS.

It is assumed that the drag resistance of successive sections of the unwrapped rod-like filler **8*b* in the cigarette making machine 101 is constant because the filler is formed in a manner as described in connection with FIG. 1 or 2. Therefore, and in the absence of other variable parameters which could influence the drag resistance of a finished cigarette 1107, the unit 116 could make identical perforations into each and every cigarette of a long series of cigarettes 1107, i.e., it would not be necessary to make any adjustments in order to change the number and/or size of holes which are burned by the laser beam 118. However, the permeability of the web 104 of cigarette paper is not always constant so that pronounced fluctuations of such permeability could influence the aforediscussed degree of ventilation of corresponding finished rod-shaped smokers' products 1107. This will be readily appreciated since, if the permeability of a certain length of the web 104 is much higher than expected, the ratio of cool atmospheric air which mixes with the column of tobacco smoke when the corresponding cigarette 1107 is lighted is much higher than desired or necessary. Analogously, the drag resistance of filter plugs 108 also influences the degree of ventilation of cigarettes 1107. Thus, if the drag resistance of a filter plug 108 is very high, it can influence the ratio of tobacco smoke to cool atmospheric air in the stream of gaseous fluid that flows into the smoker's mouth. Therefore, the structure of FIG. 3 comprises means which can influence the combined cross-sectional area of holes which are burned into the envelopes of filter plugs of cigarettes 1107 at the station PS so as to insure that fluctuations of permeability of the web 104 and/or fluctuations of drag resistance of filter plugs 108 are taken into consideration, either by effecting appropriate changes in the intensity or by effecting appropriate changes in duration of successively emitted laser beams 118**.

The signal generating device 137 which monitors the permeability of the web 104 is analogous to the signal generating device 12 of FIG. 1. The device 137 is mounted adjacent to the path of movement of the web 104 toward the wrapping station and comprises a suction chamber 138 which is adjacent to one side of the continuously moving web 104 so as to draw a stream of gaseous fluid (air) transversely across successive increments of the web. A pipe 140 connects the suction chamber 138 with the suction intake of a fan 139, and the pipe 140 contains an electropneumatic transducer 141 which transmits electric signals (denoting the monitored permeability of the web portion at the open side of the suction chamber 138) to an amplifier 142. The transducer 141 may constitute a diaphragm transducer of the type disclosed in the aforementioned U.S. Pat. No. 3,412,856 to Esenwein. The amplified signal is transmitted to one input of a signal comparing stage 143 another input of which receives a reference signal (denoting the desired or optimum permeability of the web 104) from a source 144 of reference signals (e.g., an adjustable potentiometer). The output of the signal comparing stage 143 transmits signals when the intensity or another characteristic of the signal which is transmitted by the amplifier 142 deviates from the corresponding characteristic of the reference signal from 144; such difference signals are transmitted to an analog-to-digital converter 146 which transmits digitalized signals to the first stage of a time-delay device 147 here shown as a shift register. The delay which is effected by the shift register 147 is such that the signal which is transmitted by the last stage of the shift register to the control circuit 136 for the laser 117 reaches the control circuit 136 simultaneously with arrival of the corresponding portion of the web 104 at the perforating station PS. In other words, the delay achieved by the shift register 137 equals the interval which is required by the corresponding portion of the web 104 to advance from the suction chamber 138 to the wrapping station of the machine 101, by the corresponding portion of the wrapped filler **8*b* to advance to the cutoff, by the corresponding plain cigarette 107 to advance into the machine 102, and by the corresponding filter cigarette 1107 to advance in the machine 102** to the perforating station PS.

The shift register 147 preferably comprises a row of parallel stages for each dual position of the digitalized difference signal from the converter 146. All such stages receive advancing impulses from a pulse generator including a wheel or drum 148 having projections 148A (e.g., in the form of permanent magnets) and driven by the main prime mover of the production line in synchronism with other moving parts of the machines 101 and 102. The projections 148A travel past a proximity detector 149 which is connected with the aforediscussed stages of the shift register 147. Each impulse from the detector 149 causes the signals from 146 to advance from a preceding to the next-following stage of the shift register 147. The last stage or stages of the shift register 147 transmit the digitalized signal to a digital-to-analog converter 151 (if necessary, by way of a function generator circuit 150 which will be described below) which transmits analogized signals to the input b of the control circuit 136 for the laser 117. The function generator 150 is necessary when the control circuit 136 receives several signals or, more accurately stated, when the signal which is transmitted to the input b of the control circuit 136 is a function of several parameters which influence the degree of ventilation of finished smokers' products. When the function generator 150 is not provided at all or when this function generator is inactive, signals which appear at the output of the shift register 147 are transmitted to the control circuit 136 directly by way of the converter 151.

As mentioned above, the control circuit 136 can adjust the laser 117 by varying the duration and/or intensity of the laser beam 118.

The signals which are transmitted by the transducer 141 are utilized to influence the laser 117 via control circuit 136 in such a way that the degree of ventilation is constant in spite of eventual fluctuations of permeability of the cigarette paper web 104. It is assumed here that the drag resistance of successive increments or unit lengths or sections of the filler **8*b*** is constant.

It goes without saying that the unit 116 constitutes but one form of means which can perforate the wrapping material of rod-shaped smokers' products 1107 for the purpose of admitting cool atmospheric air into the column of tobacco smoke. It is equally possible to employ a perforating unit (or two or more perforating units) for the making of holes by spark generation (reference may be had to the commonly owned copending applications Ser. Nos. 841,108 and 864,441 respectively filed by Wahle et al. on Oct. 11, 1977 and by Lüders et al. on Dec. 27, 1977) or one or more units which make holes by resorting to mechanical piercing elements in the form of needles or the like (reference may be had to commonly owned U.S. Pat. No. 4,090,826 granted May 23, 1978 to Hinzmann and to the commonly owned U.S. Pat. No. 4,121,595 granted Oct. 24, 1978 to Heitmann et al.). Furthermore, and as also disclosed in the aforementioned patent and patent applications, the perforating unit 116 or an equivalent perforating unit can be installed adjacent to the path of movement of the web 109 to make holes in this web before the latter is converted into discrete uniting bands. The making of holes in the web 109 prior to its conversion into uniting bands and thereupon into tubular outer envelopes of filter plugs can be resorted to when the outermost layers of filter plugs 108 are permeable to air and their permeability is sufficiently uniform to permit for predicatable admission of air which flows through the holes in the outer envelope (portion of the web 109).

The signals at the output c of the control circuit 136 can also be influenced by the signal generating device 110 which, as explained above, monitors the drag resistance of successive filter plugs 108 prior to attachment of such filter plugs to the corresponding plain cigarette or cigarettes 107. The signals which are transmitted by the transducer (not specifically shown but corresponding to the transducer 38) of the signal generating device 110 are digitalized by the converter 100, delayed by a shift register 105 which receives signal transporting impulses from the aforediscussed proximity detector 149, and transmitted to the digital-to-analog converter 151, either directly or via function generator circuit 150. The delay which is effected by the shift register 105 is such that a cigarette 1107 containing a portion of or the entire filter plug 108 which has been monitored by the device 110 reaches the perforating station PS when the corresponding signal reaches the control circuit 136. In other words, signals which are transmitted by the transducer of the signal generating device 110 are transported to the control circuit 136 in imitation of transport of corresponding filter plugs 108 to the station PS. In the absence of the signal generating device 137, the duration and/or intensity of laser beams 118 which are emitted by the laser 117 is a function of signals which are generated by the device 110 and denote the drag resistance of successive filter plugs 108.

FIG. 3 further shows an additional signal generating device 167 which is adjacent to the path of movement of the filler **8*b* in the cigarette making machine 101 and serves to monitor the quantity of tobacco shreds in successive increments or unit lengths of the filler. The illustrated signal generating device 167 comprises a source 168 of corpuscular radiation (preferably a source of beta rays) at one side of the path for the filler 8*b* and an ionization chamber 169 at the other side of such path opposite the source 168. The ionization chamber 169 transmits signals whose intensity or another characteristic is indicative of the weakening of beta rays during passage through successive increments of the filler, i.e., of the density of corresponding increments or unit lengths of the filler. The signal generating device 167 is preferably adjacent to the path of the wrapped or draped filler, i.e., downstream of the location where the web 104 is draped around the filler to form therewith a continuous cigarette rod which advances toward the cutoff to be subdivided into discrete plain cigarettes 107. Electric signals which are transmitted by the output of the ionization chamber 169 (or an analogous detector) are amplified by an amplifier 171 and are transmitted to the input of an analog-to-digital converter 172 whose output is connected with the first stage or stages of a further time-delay device, e.g., a shift register 173 whose stages receive signal transporting impulses from the proximity detector 149. The output of the shift register 173 transmits signals to the digital-to-analog converter 151, either directly or via function generator circuit 150. The latter is not needed when the input b of the control circuit 136 receive signals solely from the signal generating device 167**.

The function generating circuit 150 is desirable when the input b of the control circuit 136 receives signals whose intensity or another characteristic is a function of several variable parameters, e.g., a function of signals which are transmitted by the devices 110, 137, by the devices 110, 167, by the devices 137, 167, or by the devices 110, 137, 167. The signals from each of the devices 110, 137, 167 (or any two of these devices) are properly delayed so that they reach the control circuit 136 via circuit 150 at the exact time when the corresponding constituents of the rod-shaped smokers' products 1107 are located at the perforating station PS. Thus, the shift register 147 delays the corresponding signals in such a way that the portion of the web 104 whose monitoring resulted in transmission of a signal by the last stage of the shift register 147 is located at the station PS when the corresponding signal reaches the respective inputs of the circuit 150. The shift register 105 delays the signals from the transducer of the signal generating device 110 in such a way that the filter plug 108 whose monitoring resulted in generation of a signal is located at the station PS when the corresponding signal reaches the respective inputs of the circuit 150. The shift register 173 delays the signals which are transmitted by the transducer 171 in such a way that the corresponding portion of the wrapped filler **8*b* (i.e., the corresponding plain cigarette 107) reaches the station PS when the respective signal or signals reach the corresponding input or inputs of the circuit 150**.

The function generating circuit 150 stores signals which denote satisfactory drag resistance of filter plugs 108, which denote satisfactory density of predetermined lengths of the filler **8*b*, and which denote satisfactory permeability of predetermined lengths of the web 104. Therefore, the circuit 150 can transmit to the input b of the control circuit 136 signals which are generated by full consideration of several variable parameters (denoted by signals from any two or all three of the signal generating devices 110, 137, 167) so that the combined cross-sectional area of holes in the outer envelope of each of a series of successive filter plugs advancing beyond the perforating station PS is such as is necessary to insure that the degree of ventilation of all smokers' products 1107 is the same or deviates only negligibly from the predetermined optimum value. It is clear that the adjustment of laser 117 can be carried out in such a way that the ultimate result of such adjustment is segregation of predetermined quantities of condensate from the column of gaseous fluid which enters the mouth of the smoker. As mentioned above, the function generator circuit 150 can be used to influence the combined cross-sectional area of holes in the outer envelopes of successive filter plugs in dependency on a plurality (two or more) different variable parameters which, in the embodiment of FIG. 3, include the permeability of the web 104, the density of the filler 8***b* and the drag resistance of filter plugs 108.

The main reason for maintaining the degree of ventilation at a constant value is that the percentage of condensate in the cigarettes of a given brand should remain unchanged or should fluctuate within a very narrow range. The percentage of condensate is influenced by at least one parameter other than that parameter or those parameters which do not directly influence the degree of ventilation, namely, by the quantity of tobacco in the filler 8*b*. When the quantity of tobacco per unit length of the filler is higher and the degree of ventilation is unchanged, the quantity of condensate can increase. Therefore, it is desirable to provide the signal generating device 167 which monitors the quantity of shreds in successive increments of the filler 8*b* and transmits signals which are used to adjust the perforating unit 116, i.e., the degree of ventilation. This insures that the quantity of condensate in the cigarettes 1107 is constant.

The monitoring of drag resistance of filter plugs 108 is not critical because the drag resistance of a filter cigarette is not overly influenced by eventual minor fluctuations of drag resistance of its filter plug. In other words, ascertainment of the drag resistance of plain cigarettes which form part of filter cigarettes 1107 is normally more important than the ascertainment of drag resistance of filter plugs.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of producing a rod-like filler from shreds which consist of tobacco or another smokable material, comprising the steps of building a continuous stream wherein each unit length contains a quantity of shreds in excess of that in a unit length of the filler; moving the stream lengthwise; removing said excess from successive increments of the moving stream to convert the stream into said filler; monitoring the resistance of the filler to the axial flow of a gas therethrough; generating a signal which is a function of resistance of the filler to such axial flow; and utilizing said signal for adjustment of said removing step when said resistance deviates from a predetermined value.

2. The method of claim 1, wherein said signal generating step includes ascertaining the resistance of successive equally long rod-like portions of said filler and said adjusting step includes respectively removing larger and smaller quantities of shreds when the resistance respectively exceeds and is below said predetermined value.

3. The method of claim 1, wherein said removing step includes removing said excess in several successive stages.

4. The method of claim 3, wherein said excess includes an inner layer and an uneven outer layer of said stream, said stages including a first stage of removing said outer layer and a second stage of removing said inner layer.

5. The method of claim 1, wherein said signal generating step comprises conveying a stream of gaseous fluid transversely across successive increments of the filler and ascertaining that pneumatic value of the fluid stream which fluctuates as a function of deviations of resistance of successive increments of the filler to the axial flow of said fluid stream from a predetermined resistance.

6. The method of claim 5, wherein said fluid is air.

7. The method of claim 1 further comprising the steps of draping said filler into a web of wrapping material and subdividing the draped filler into a succession of sections of predetermined length, said signal generating step comprising conveying a stream of gaseous fluid axially through successive sections and ascertaining that pneumatic value of the fluid stream which fluctuates as a function of deviations of resistance of successive sections to the flow of said fluid stream from a predetermined resistance.

8. The method of claim 7, wherein said fluid is air.

9. The method of claim 1, further comprising the steps of draping said filler into a web of air-permeable wrapping material and generating a second signal which is a function of permeability of the wrapping material.

10. The method of claim 9, further comprising the steps of subdividing the draped filler into a succession of rod-like sections of predetermined length, perforating the wrapping material of successive sections including making at least one hole in the wrapping material of each section, and utilizing said second signal for adjustment of said perforating step so as to change the cross-sectional area of the holes in the wrapping material of said sections when the monitored permeability of said wrapping material deviates from a predetermined value.

11. The method of claim 1, further comprising the step of generating an additional signal which is a function of the quantity of shreds in successive increments of said filler.

12. The method of claim 11, further comprising the steps of draping a web of wrapping material around said filler, subdividing the draped filler into a succession of rod-like sections of predetermined length, perforating the wrapping material of successive sections including making at least one hole in the wrapping material of each section, and utilizing said additional signal for adjustment of said perforating step so as to change the cross-sectional area of holes in the wrapping material of said sections when the monitored quantity deviates from a predetermined value.

13. The method of claim 1, further comprising the steps of draping said filler into a web of wrapping material, subdividing said filler into a succession of rod-like sections of predetermined length, connecting each of said sections with a filter plug to form a succession of filter tipped smokers' products, perforating the wrapping material of successive products including making at least one hole in the wrapping material of each product, generating further signals as a function of the resistance to the axial flow of a gaseous fluid through the filter plugs, and utilizing said further signals for adjustment of said perforating step so as to change the cross-sectional area of holes in the wrapping material of said products when the monitored resistance of said filter plugs deviates from a predetermined value.

14. Apparatus for making a rod-like filler from shreds which consist of tobacco or another smokable material, comprising conveyor means defining an elongated path; means for feeding shreds into a first portion of said path in such quantities that the stream of shreds which accumulates in and advances beyond said first portion contains shreds in excess of those per unit length of the filler; adjustable means for removing the excess of shreds from said stream whereby the remaining shreds of said stream constitute said filler; means for monitoring the resistance of the filler to the axial flow of a gas therethrough, including means for generating signals denoting the resistance of the filler to such axial flow; and means for adjusting said removing means when a characteristic of said signals deviates from a predetermined value.

15. Apparatus as defined in claim 14, wherein said removing means comprises a first trimming device adjacent to a second portion of said path and a second trimming device downstream of said first trimming device, said adjusting means being arranged to adjust said second trimming device.

16. Apparatus as defined in claim 14, wherein said signal generating means comprises means for conveying a fluid stream transversely across said stream and transducer means operative to generate said signals as a function of a characteristic of the thus modulated fluid stream.

17. Apparatus as defined in claim 14, further comprising means for draping a web of wrapping material around said filler and means for subdividing the draped filler into sections of predetermined length, said signal generating means comprising means for conveying a gas stream axially through successive sections of said filler.

18. Apparatus as defined in claim 14, further comprising a source of air-permeable web-like wrapping material, means for draping said material around said filler and means for generating second signals as a function of permeability of successive increments of said web.

19. Apparatus as defined in claim 14, further comprising means for draping said filler into a web of wrapping material to form a wrapped filler, means for subdividing said wrapped filler into rod-like sections of predetermined length, means for attaching filter plugs to said sections, and means for generating second signals denoting the resistance of said filter plugs to axial flow of a gaseous fluid therethrough.

20. Apparatus as defined in claim 14, further comprising means for generating second signals denoting the quantity of smokable material in successive increments of said filler.

21. Apparatus as defined in claim 14, further comprising means for draping a web of foraminous wrapping material around said filler, means for subdividing the wrapped filler into rod-like sections of predetermined length, means for attaching filter plugs to said sections, adjustable perforating means for making holes in the wrapping material of said sections, means for generating at least one second signal whenever the permeability of said wrapping material, the resistance of a filter plug to axial flow of a gas therethrough and/or the density of a unit length deviates from a fixed value, and control means for adjusting said perforating means as a function of said second signal.

22. Apparatus as defined in claim 21, wherein said control means comprises means for adjusting said perforating means in response to deviation of at least two different second signals from fixed values.

* * * * *

UNITED STATES PATENT AND TRADEMARK OFFICE

CERTIFICATE OF CORRECTION

PATENT NO. : 4,306,573

DATED : December 22, 1981

INVENTOR(S) : Willy RUDSZINAT

It is certified that error appears in the above-identified patent and that said Letters Patent is hereby corrected as shown below:

Title page, item [73], "Hauni-Werke KUM/o/rber & Co. KG, Hanburg, Fed. Rep. of Germany" should read --Hauni-Werke Körber & Co. KG., Hamburg, Fed. Rep. Germany--.

Col. 6, line 31, "steps" should read --stages--.

Signed and Sealed this

Twenty-second Day of June, 1993

Michael K. Kirk

MICHAEL K. KIRK

*Acting Commissioner of Patents and Trademarks*

*Attest:*

*Attesting Officer*